US005697771A

United States Patent [19]

Arndt et al.

[11] Patent Number: 5,697,771

[45] Date of Patent: Dec. 16, 1997

[54] VACUUM PUMP WITH OIL SEPARATOR

[75] Inventors: Lutz Arndt, Troisdorf; Winfried Kaiser, Lorrach; Peter Muller, Cologne, all of Germany

[73] Assignee: Leybold Aktiengesellschaft, Cologne, Germany

[21] Appl. No.: 596,222

[22] PCT Filed: Aug. 11, 1994

[86] PCT No.: PCT/EP94/02675

§ 371 Date: Feb. 15, 1996

§ 102(e) Date: Feb. 15, 1996

[87] PCT Pub. No.: WO95/05540

PCT Pub. Date: Feb. 23, 1995

[30] Foreign Application Priority Data

Aug. 17, 1993 [DE] Germany ..... 43 27 583.4

[51] Int. Cl.[6] ..... F04C 25/02; F04C 27/02

[52] U.S. Cl. ..... 418/15; 418/87; 418/97; 418/DIG. 1

[58] Field of Search ..... 418/15, 87, 97, 418/DIG. 1

[56] References Cited

U.S. PATENT DOCUMENTS

| | | | |
|---|---|---|---|
| 4,204,815 | 5/1980 | LeBlanc | 418/13 |
| 4,268,230 | 5/1981 | Bassan | 418/15 |

FOREIGN PATENT DOCUMENTS

| | | | |
|---|---|---|---|
| 0401339 | 12/1990 | European Pat. Off. . | |
| 1098150 | 1/1961 | Germany . | |
| 1123076 | 2/1962 | Germany | 418/DIG. 1 |
| 60-30494 | 2/1985 | Japan | 418/87 |
| 863162 | 3/1961 | United Kingdom . | |
| 948927 | 2/1964 | United Kingdom | 418/DIG. 1 |
| 2081383 | 2/1982 | United Kingdom . | |

*Primary Examiner*—John J. Vrablik
*Attorney, Agent, or Firm*—Harris Beach & Wilcox, LLP

[57] ABSTRACT

The invention relates to a vacuum pump (1) with an oil separator (42) connected downstream of its outlet (33) and with a duct (45, 46) through which the oil separated in the oil separator (42) is returned to the vacuum pump (1); to feed back the oil in a simple manner, the oil feed duct (45, 46) opens into a duct (47) that supplies gas ballast to the pump (1).

3 Claims, 2 Drawing Sheets

VACUUM PUMP WITH OIL SEPARATOR

BACKGROUND OF THE INVENTION

The invention relates to a vacuum pump and in particular, to a vacuum pump with a gas ballast facility.

Supplying the gas ballast means the admission of gases into the pump chamber of a vacuum pump at a point of time when the pump chamber is sealed off towards the intake side. By supplying gas ballast it is possible to prevent damaging condensation of vapours which are taken in. In the case of a two-stage vacuum pump the gas ballast is commonly supplied into the fore-vacuum stage. But it is also known to supply the gas ballast to the high vacuum stage.

SUMMARY OF THE INVENTION

Oil sealed pumps pump together with the gas flow an oil flow which enters from the oil reservoir into the pump during each turn. The pumped oil is returned to the oil reservoir. Gases with entrained oil vapours are delivered to the pump's outlet. Thus generally an internally or externally connected oil separator or gas filter is connected downstream of the outlet of such pumps, where in this oil separator the by far greater part of the entrained oil vapours are separated from the gas flow.

DESCRIPTION OF THE INVENTION

It is known to return the oil which is separated in the gas filter back through the inlet of the pump. The oil returned back to the suction side of the pump impairs the ultimate pressure; moreover, there exists the danger of unwanted backstreaming of oil into the connected recipient, which may lead to faults in the processes being run in the recipient.

In another solution, the oil separated in the gas filter is returned directly to the oil sump of the pump. This kind of oil return is only possible if an auxiliary pump is present, or—which is generally not the case—the gas filter is arranged so far above the pump chamber that the oil flows—owing to its gravitational force—back into the oil sump.

From DE-B-10 98 150 a rotary piston pump vacuum pump is known where an oil separator follows at its outlet. The oil separator is designed as a cyclone. Moreover, the known vacuum pump has a gas ballast facility which comprises a gas channel with a valve. A side channel which leads to the oil separator opens into said gas channel. The side channel has the effect that the oil mist contained in the chamber of the oil separator is partly sucked in as gas ballast into the work space of the pump. If aggressive gases are pumped with this pump, then there exists the disadvantage that these enter the pump chamber of the pump once more. Moreover, the side channel does not serve the purpose of returning the oil which has been separated in the oil separating chamber.

Also the contents of GB-A-863 162 belong to the state-of-the-art. This document lays open a gas compressor. An oil separator from which oil might be returned is not present.

It is the task of the present invention to create a vacuum pump having the aforementioned characteristics in which the danger of returning aggressive gases back to the pump chamber no longer exists and in which the means for returning the oil from the oil separator are designed to be especially simple.

In the case of this solution according to the present invention, only the oil from the oil separator returns via the gas ballast facility back into the pump chamber of the vacuum pump. Aggressive gases which are pumped into the oil separator are not again returned to the pump chamber of the vacuum pump.

A different solution to the task of the present invention, which may only be implemented in the case of two-stage vacuum pumps, is that the duct which serves the purpose of returning the separated oil opens into an intermediate channel which links the outlet of the high vacuum stage to the inlet of the fore-vacuum stage.

In the case of both proposed solutions the duct which serves the purpose of returning the oil opens at a point in the vacuum pump, where during operation of the vacuum pump a low pressure prevails which ensures pumping of the oil from the oil separator to the pump. The influence on the ultimate pressure characteristic is negligible. The danger of oil backstreaming into the connected recipient no longer exists. Returning the oil into the duct which serves the purpose of supplying the gas ballast offers the additional advantage of being particularly simple, cost-effective and suitable for retrofitting. Further advantages and details of the present invention shall be explained by referring to a two-stage rotary vane vacuum pump presented in the drawing figures.

Figure 1:
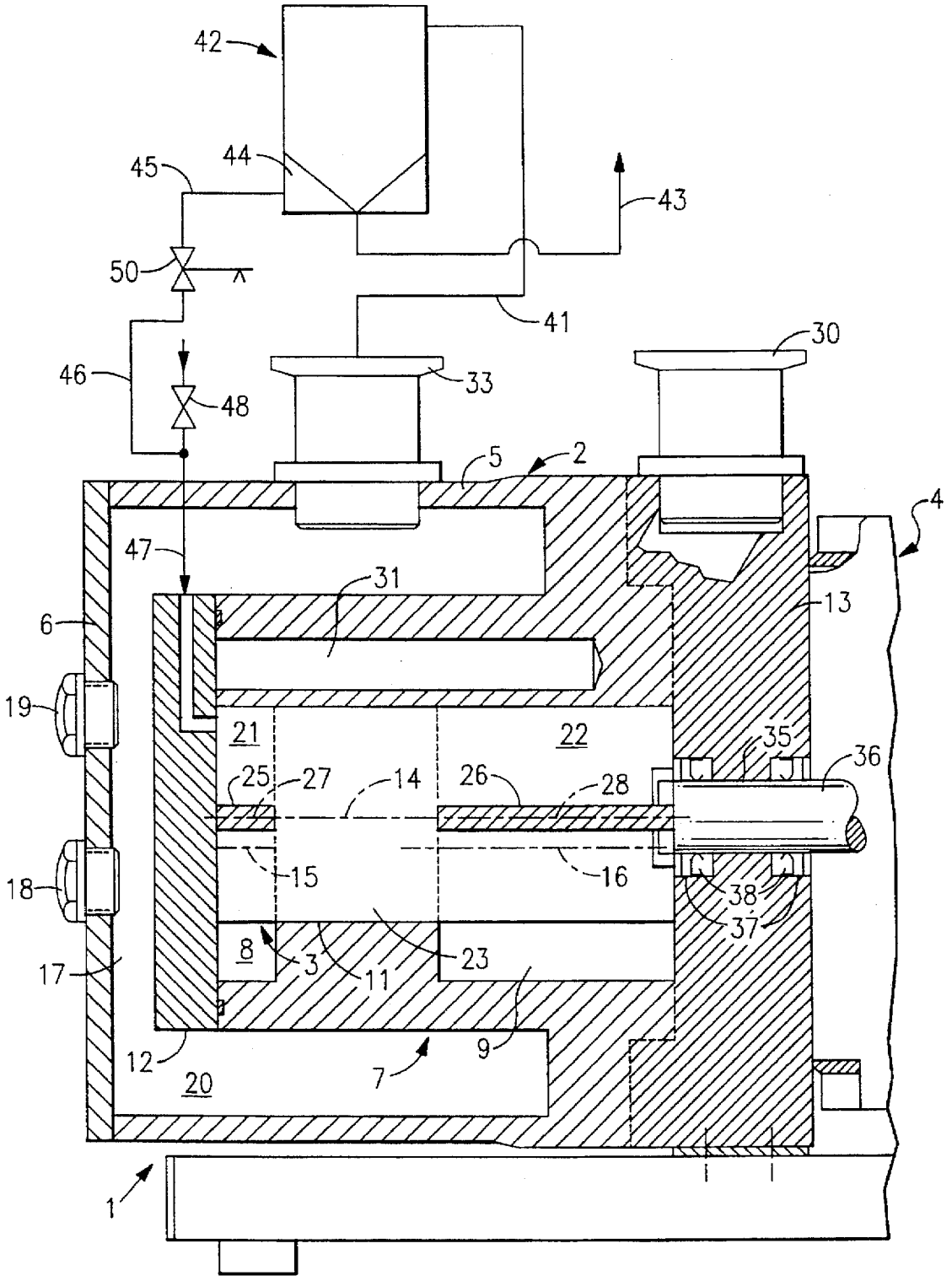
FIG. 1 shows a vacuum pump with a passage for permitting oil to be returned to the pump from outside the vacuum pump housing according to an embodiment of the invention.

The rotary vane vacuum pump 1 presented in FIG. 1 comprises chiefly the subassemblies housing 2, rotor 3 and drive motor 4.

Housing 2 substantially has the shape of a pot with an outer wall 5, with the lid 6, with an inside section 7 containing pump chambers 8, 9 as well as bearing bore 11 with end piece 12 and bearing piece 13, which limit on their face sides the pump chambers 8, 9. The axis of the bearing bore 11 is designated as 14. Arranged eccentrically to this are the axes 15 and 16 of the pump chambers 8, 9. Oil space 17, which during operation of the pump is partly filled with oil, is situated between outer wall 5 and the inside section 7. Two oil level glasses 18, 19 (maximum, minimum oil level) are provided in lid 6 for checking the oil level. Oil-fill and oil-drain ports are not shown.

Rotor 3 is situated within inside section 7. The rotor is made of one piece and has two anchor segments 21, 22 arranged on the face side and a bearing segment 23 situated between the anchor segments 21, 22. Bearing segment 23 and anchor segments 21, 22 are of identical diameter. Anchor segments 21, 22 are equipped with slots 25, 26 for vanes 27, 28. These are milled from each of the respective face sides of the rotor so that precise slot dimensions can be easily attained. Bearing segment 23 is situated between anchor segments 21, 22. Bearing segment 23 and bearing bore 11 form the sole bearing of the rotor.

The anchor segment 22 and the corresponding pump chamber 9 are made longer than anchor segment 21 with pump chamber 8. Anchor segment 22 and pump chamber 9 form the high vacuum stage. During operation, the inlet of the high vacuum stage 9, 22 is linked to intake port 30. The outlet of the high vacuum stage 9, 22 and the inlet of the fore-vacuum stage 8, 21 are linked via housing bore or intermediate channel 31, which extends in parallel to axes 15, 16 of the pump chambers 8, 9. The outlet of the fore-vacuum stage 8, 21 opens into the oil space 17 which comprises oil sump 20. In oil space 17 the oil containing gases quiet down and leave the pump 1 through outlet 33. For reasons of clarity, the inlet and outlet openings of the two pump stages are not shown in the drawing figure.

The bearing piece 13 is equipped with a bore 35 for the shaft 36 of drive motor 4, said bore extending coaxially with respect to axis 14 of bearing bore 11. Sealing of the shaft 36 against bearing piece 13 is performed through shaft sealing rings 37 in recesses 38. The coupling of the rotor 3 to the drive shaft 36 is performed by way of a positive fit via projections and corresponding recesses.

Figure 2:
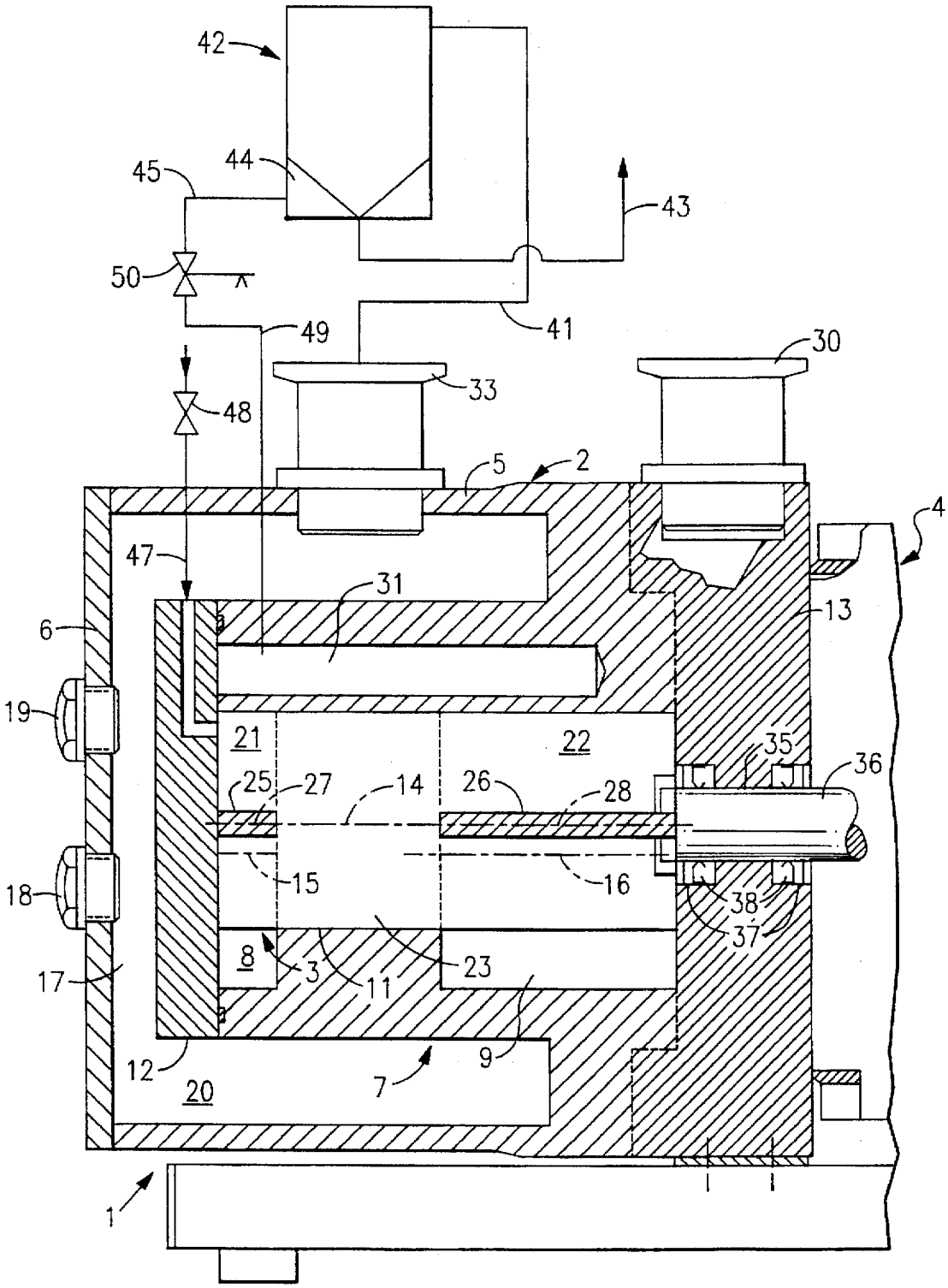
FIG. 2 shows a vacuum pump with a passage for permitting oil to be returned to the pump from outside the vacuum pump housing according to an alternative embodiment.

Referring also to FIG. 2, following at the outlet 33 of pump 1 there is connected a duct 41 which opens into the oil separator or gas filter 42. The gas which has been freed of oil vapours leaves the oil separator via duct 43. The separated oil collects in oil collection chamber 44 and is returned back to the oil reservoir of pump 1.

Two alternatives for returning the oil are presented. In the case of the first alternative, as shown in FIG. 1, the separated oil passes via duct sections 45, 46 into duct 47 which serves the purpose of supplying the gas ballast into the fore-vacuum stage 8, 21 of pump 1. Preferably duct section 46 opens into duct 47 at a point which is located—with respect to the direction of the gas ballast flow—downstream of gas ballast valve 48. This ensures that the oil can be returned even when the gas ballast valve is closed.

In the case of the second alternative, as shown in FIG. 2, the separated oil flows through duct sections 45 and 49. The duct section 49 which is represented by the broken lines opens into intermediate channel 31.

Preferably a float valve 50 is situated in duct section 45. This ensures that duct 45 is blocked when no separated oil which is to be returned is present. Venting of pump 1 is thus avoided.

What is claimed is:

1. Vacuum pump (1), comprising:

an oil separator (42) connected downstream of an outlet (33) of said vacuum pump;

a gas ballast facility which comprises a first duct (47) for the purpose of supplying gas, a gas ballast valve (48), and a second duct (45, 46):

said gas ballast valve (48) being outside a housing (2) of said vacuum pump (1); and said second duct (45, 46) being connected to the first duct (47);

wherein the second duct (45, 46) is connected to an oil collection chamber (44) of the oil separator (42).

2. Pump according to claim 1, wherein said second duct (45, 46) opens into the first duct (47) at a point which lies downstream of said gas ballast valve (48) with respect to a direction of flow of a gas ballast.

3. Pump according to claim 1, wherein a float valve is situated in the second duct (45, 46).

* * * * *